US007108468B2

(12) United States Patent
Till et al.

(10) Patent No.: US 7,108,468 B2
(45) Date of Patent: Sep. 19, 2006

(54) METHODS AND SYSTEMS FOR CONTROLLING SHUTDOWN AND OPERATION OF A MODULE WITHIN A SLOT IN A SHELF OF A RACK-BASED COMPUTING SYSTEM

(75) Inventors: David P. Till, Cary, NC (US); John Lytle, Raleigh, NC (US); George B. Robinson, Jr., Garner, NC (US); Peter Joseph Marsico, Chapel Hill, NC (US); Christopher F. Lambiotte, Spokane, WA (US)

(73) Assignee: Tekelec, Calabasas, CA (US)

( * ) Notice: Subject to any disclaimer, the term of this patent is extended or adjusted under 35 U.S.C. 154(b) by 0 days.

(21) Appl. No.: 11/003,582

(22) Filed: Dec. 3, 2004

(65) Prior Publication Data

US 2006/0094276 A1 May 4, 2006

Related U.S. Application Data

(60) Provisional application No. 60/624,037, filed on Nov. 1, 2004.

(51) Int. Cl.
*H01R 13/44* (2006.01)

(52) U.S. Cl. ..... 410/135

(58) Field of Classification Search ..... 439/327, 439/304, 136, 159, 218, 188, 535, 367, 133, 439/135, 131, 140; 200/43.02
See application file for complete search history.

(56) References Cited

U.S. PATENT DOCUMENTS 4,479,688 A * 10/1984 Jennings ..... 200/43.02
5,009,610 A * 4/1991 Woskow ..... 439/142
5,061,199 A * 10/1991 McClead ..... 439/304
5,740,012 A * 4/1998 Choi ..... 361/686
5,793,614 A * 8/1998 Tollbom ..... 361/732
5,993,225 A * 11/1999 Johnson et al. ..... 439/136
6,540,534 B1 * 4/2003 Vo et al. ..... 439/188
6,863,561 B1 * 3/2005 Gorman ..... 439/535

OTHER PUBLICATIONS

"PICMG 3.0 Specification", PCI Industrial Computers, pp. 1-34 (Jan. 2003).

* cited by examiner

*Primary Examiner*—Chandrika Prasad
(74) *Attorney, Agent, or Firm*—Jenkins, Wilson, Taylor & Hunt, P.A.

(57) ABSTRACT

Methods and systems are described for preventing disconnection of a module from a module connector prior to initiating a shutdown routine and for preventing operation of the module unless a retention device is engaged. The system includes a switch having a first state for allowing operation of a module and a second state for initiating shutdown and/or preventing operation of the module. At least one retention device prevents disconnection of the module from the module connector. A covering member is movable between first and second positions, but is prevented from moving to the first position when the retention device in not engaged. In the first position, the covering member prevents access to the retention device and the switch is in the first state and in the second position the covering member allows access to the retention device and transitions the switch to the second state.

44 Claims, 11 Drawing Sheets

METHODS AND SYSTEMS FOR CONTROLLING SHUTDOWN AND OPERATION OF A MODULE WITHIN A SLOT IN A SHELF OF A RACK-BASED COMPUTING SYSTEM

RELATED APPLICATIONS

This application claims the benefit of U.S. Provisional Application No. 60/624,037, filed Nov. 1, 2004, entitled "Methods and Systems for Preventing Disconnection of a Module from a Module Connector Prior to Initiating Module Shutdown and Preventing Operation of the Module Unless a Retention Device is Engaged," the disclosure of which is incorporated by reference herein in its entirety.

TECHNICAL FIELD

The subject matter disclosed relates to module operation control techniques, and more particularly to controlling the operation and shutdown of a module.

RELATED ART

The PCI Industrial Computer Manufacturers Group (PICMG) defines open architecture modular computing components that can be quickly integrated to deploy high performance services solutions. The PICMG 3.0 Advanced Telecommunications Computing Architecture (ATCA) specification offers guidelines on the design of ATCA compliant boards and systems.

In an ATCA system one or more shelves are mounted within a support enclosure, often referred to simply as a rack. Each shelf includes slots for a number of modules, typically one or more shelf manager modules and a number of front board modules (FB) that connect via connectors to a midplane of the shelf. Currently, the ATCA specification calls for a maximum of sixteen FBs per shelf, but this is subject to change as the ATCA specification evolves. Each shelf also includes a midplane with connectors for mating to the FBs, cooling devices, power supplies, external connections for communicating with networks, additional electronics, and the necessary hardware to keep everything in place.

FIG. 1 is a side view illustrating a conventional FB 100 connected to a midplane 102 in an ATCA system. FB 100 includes circuit board 104, a face plate 106, zone 1 connector(s) 108, zone 2 connector(s) 110, zone 3 connector(s) 112, and alignment pin(s) 114. FB 100 slides on guides 116 into and out of position in the direction shown by arrows 118. A midplane 102 includes connectors 120 that correspond to zone 2 connectors 110. Similarly, midplane 102 includes a connector 121 that corresponds to zone 1 connector 108. Zone 1 mating connectors 121 and 108 are primarily used to connect to external support power, management, and other ancillary functions for FB 100. Zone 2 mating connectors 120 and 110 are part of the data transport interface and are used primarily to exchange data between FB 100 and other modules in communication either directly or indirectly with midplane 102. Face plate 106 is attached at a front edge of circuit board 104 and is oriented perpendicularly to circuit board 104. Face plate 106 includes retention screws 122 to secure FB 100 into the shelf assembly. Face plate handles 124 rotate outward to eject FB 100 from the shelf assembly along guides 116.

FIG. 2 is a side view illustrating FB 100 connected to a midplane and to a rear transition module (RTM) 200 in an ATCA system. Rear transition module 200 also includes a circuit board 202 and a face plate 204 with handles 206 and retention screws 208. RTM 200 connects to zone 3 connector 112 of FB 100 via zone 3 connector 210. RTMs 200 are typically used to simplify the servicing of FBs 100 by providing for the termination of input and output cable assemblies and other user-defined connections on RTM 200 instead of on FB 100.

FIG. 3 is a front view illustrating a conventional FB 100. In FIG. 3, face plate 106 includes retention screws 122 and handles 124 at the top and bottom. Retention screws 122 are typically thumb screws. Handles 124 are rotationally coupled to face plate 106 between a return flange 300 of face plate 106 and circuit board 104 and rotate outwards to eject FB 100.

FIG. 4A is a top view illustrating a front portion of conventional FB 100. In FIG. 4A, an alignment pin 400 attached to the back side of face plate 106 aligns FB 100 with the shelf slot as FB 100 is slid into the shelf slot. Retention screw 122 screws into a support member 402 of the shelf to retain FB 100 in position within the shelf slot.

FIG. 4B is a side view illustrating a front portion of a conventional FB 100. Handle 124 includes a tab 404 that engages a switch 406 when handle 124 is in a seated position as shown. When an operator rotates handle 124 in a direction 408, handle 124 disengages switch 406 to indicate that FB 100 is about to be removed. As the rotation of handle 124 is continued, an end 410 of handle 124 presses against support member 412 of the shelf, which applies an outward force that slides FB 100 in an outward direction 414. Typically, both handles 124 are rotated simultaneously to slide FB 100 out, thus disconnecting the mating connectors at the back of FB 100.

In operation, an operator is expected to first unscrew retention screws 122 and then to rotate handles 124 a small amount to disengage handle tab 404 from switch 406. When switch 406 is disengaged, an indication is provided to the system that FB 100 is about to be removed and to begin a shutdown routine to prepare for its removal. An indicator light on face plate 106 is also typically illuminated to indicate that a shutdown is in progress. FB 100 requires time to shutdown prior to its removal. During the shutdown routine, many tasks are performed to prevent the loss or corruption of data. For example, the file system integrity is maintained by transferring files that are currently in use by FB 100. In addition, any processor or processors on FB 100 transition to a known good state in preparation for the removal of power to prevent the operating system from becoming corrupted. Finally, other entities and/or modules in the system can also take steps to prepare for FBs 100 removal.

One problem with the conventional ATCA approach, however, is that an operator must remember to wait until shutdown is complete before removing FB 100 from its connections. Without any advanced training and/or discipline on the part of the operator, the operator is likely to simply remove the retention screw and pull both handles to eject the FB. Instant disengagement of the FB may not allow enough time for a proper shutdown of the FB. Consequently, data can be lost and/or corrupted.

A need therefore exists for systems and methods for preventing disconnection of a module from a module connector prior to initiating a shutdown routine.

SUMMARY

In one aspect, a system is disclosed for preventing disconnection of a module from a module connector prior to initiating a shutdown routine. The system includes a switch having a first state during normal operation of a module and a second state for initiating shutdown of the module. At least one retention device prevents disconnection of the module from the module connector. A covering member is movable between first and second positions with regard to the retention device and the switch. In the first position, the covering member prevents access to the retention device and the switch is in the first state, and in the second position, the covering member allows access to the retention device and transitions the switch to the second state.

In another aspect, a system is disclosed for preventing operation of a module unless a retention device is engaged. A switch has a first state for allowing operation of a module and a second state for preventing operation of the module. At least one retention device has an engaged position for preventing disconnection of the module from a module connector and a disengaged position for allowing disconnection of the module from the module connector. A covering member is movable between first and second positions with regard to the retention device and the switch. The covering member is operatively associated with the switch so that the switch is in the first state when the covering member is in the first position and in the second state when the covering member is in the second position. The covering member is prevented from moving to the first position and transitioning the switch to the first state when the retention module is in the disengaged position.

In another aspect, a method for preventing disconnection of a module from a module connector prior to initiating a shutdown routine is disclosed. A covering member is moved from a first position in which the covering member prevents access to at least one retention device used to retain a module in electrical contact with a module connector to a second position in which the retention device is accessible to a user for removing the module from the module connector. Responsive to the covering member being in the second position, a signal is generated to initiate a shutdown routine for the module.

In another aspect, a method for preventing operation of a module unless a retention device is engaged includes providing a retaining device having an engaged position for holding the module in a module connector and a disengaged position for allowing removal of the module from the module connector. A switch that has a first state for allowing normal operation of the module and a second state for stopping operation of the module is also provided. The switch is prevented from transitioning to the first state when the retention device is in the disengaged position.

BRIEF DESCRIPTION OF THE DRAWINGS

Objects and advantages of the present invention will become apparent to those skilled in the art upon reading this description in conjunction with the accompanying drawings, in which like reference numerals have been used to designate like elements, and in which.

DETAILED DESCRIPTION

According to one aspect of the invention, access to a retention device, e.g., retention screw, may be prevented until a shutdown procedure is initiated. The retention device may be designed to delay removal of a module for a predetermined amount of time defined by the time required for the operation to disengage the retention device. As a result, the time required by the operator to disengage the retention device can be used advantageously for execution of the shutdown routine. For example, by blocking access to a thumb screw with a covering member and then initiating a shutdown routine when the operator moves the covering member to gain access to the thumb screw, the shutdown routine would be allowed to run during the time the operator loosens the thumb screw prior to disconnecting the module from the system. Thus, such an arrangement prevents disconnection of a module from a module connector, e.g., from a connector on a midplane, prior to initiating a shutdown routine.

Figure 1:
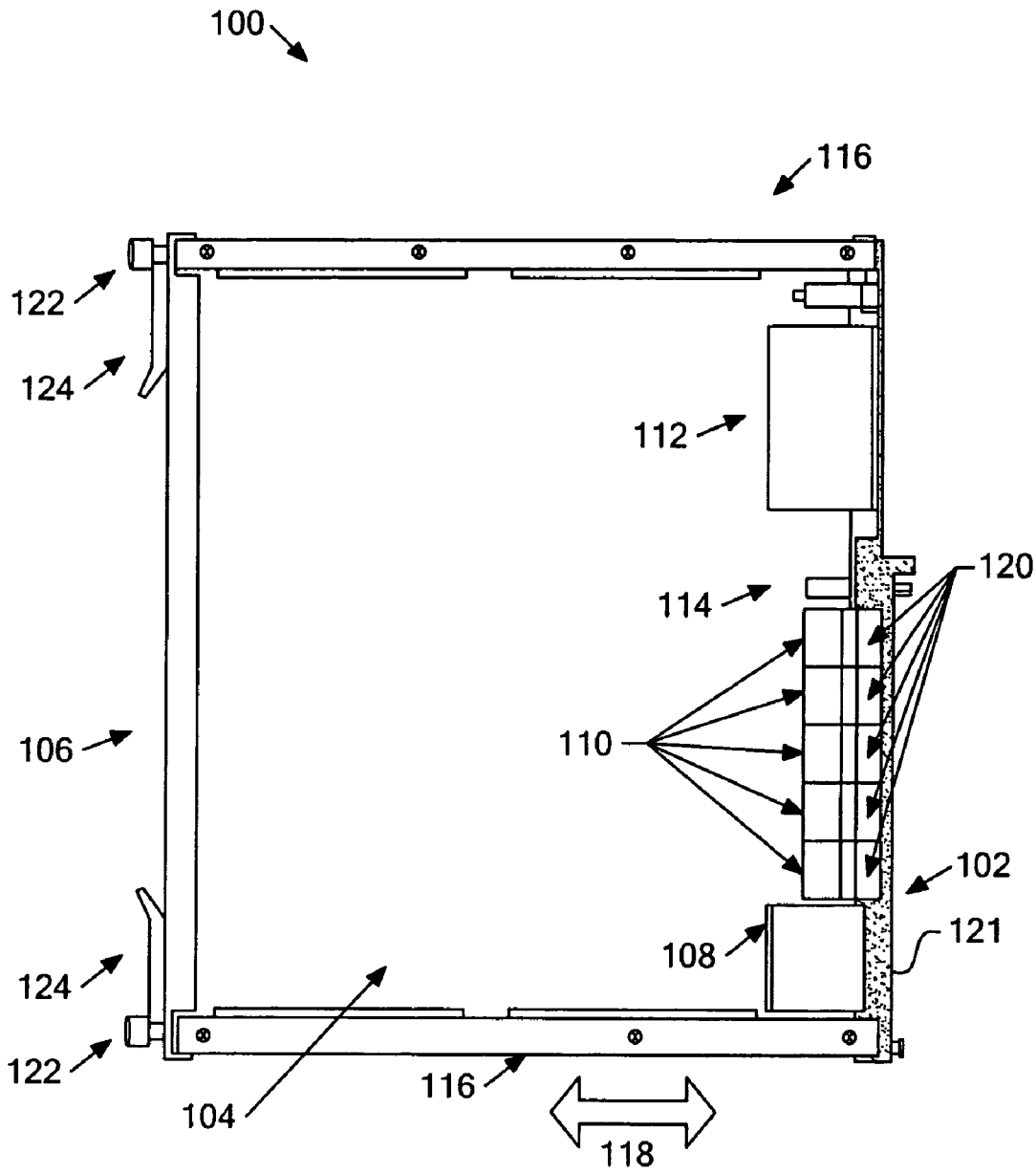
FIG. 1 (Prior Art)
FIG. 1 is a side view illustrating a conventional front board module connected to a midplane in an ATCA system.
Figure 2:
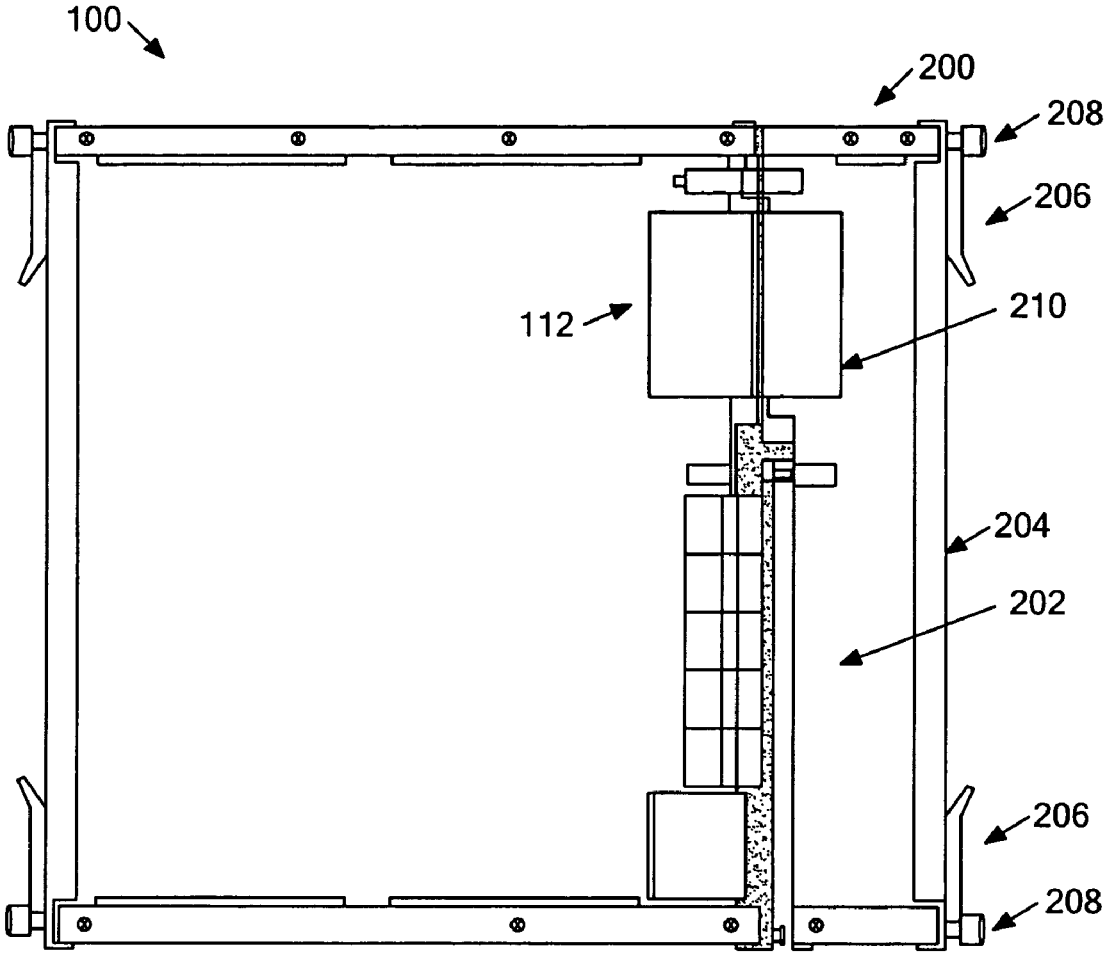
FIG. 2 (Prior Art)
FIG. 2 is a side view illustrating a conventional front board module connected to a midplane and to a rear transition module in an ATCA system.
Figure 3:
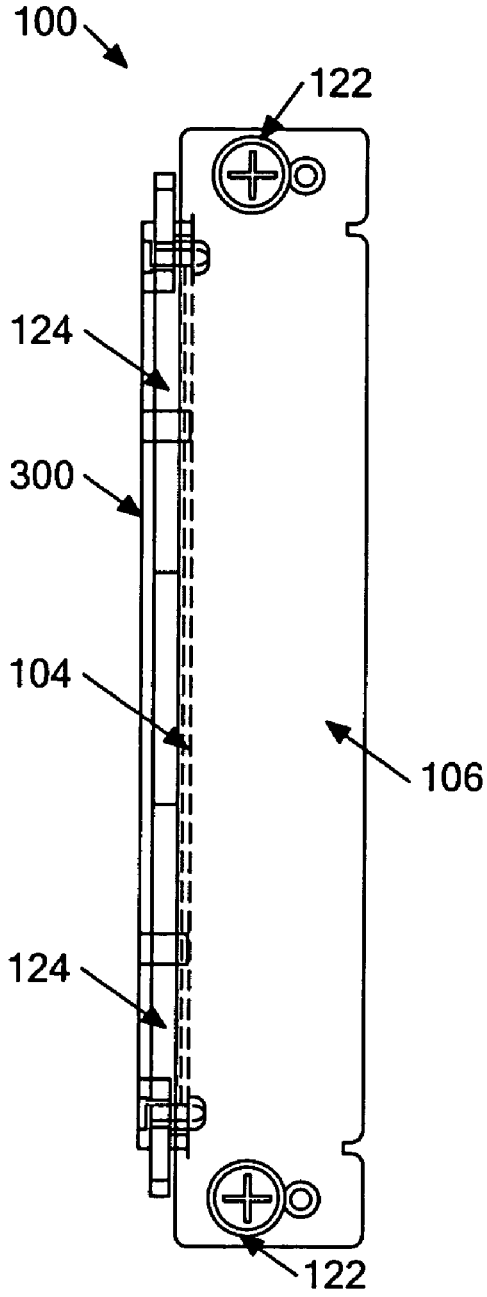
FIG. 3 (Prior Art)
FIG. 3 is a front view illustrating a conventional front board module.
Figure 4B:
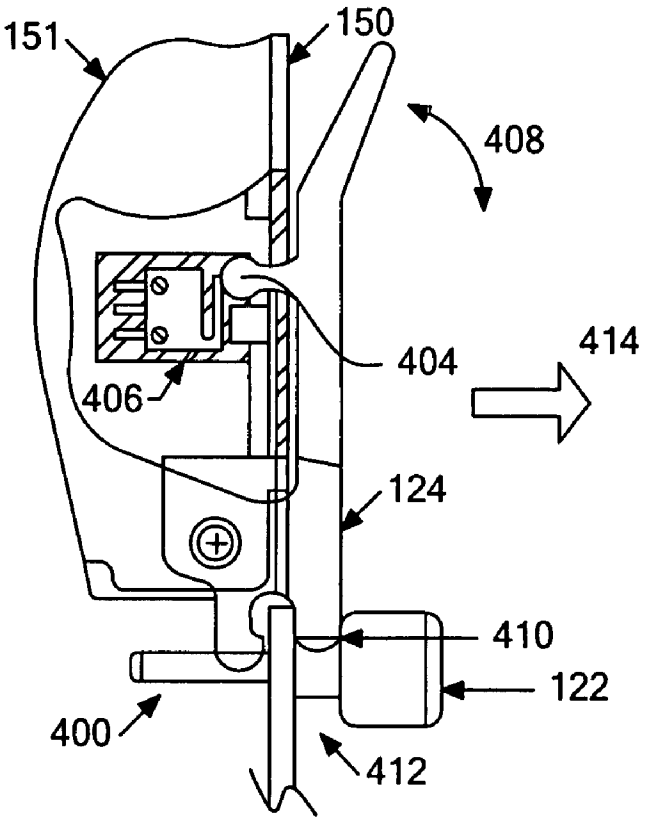
FIG. 4B (Prior Art)
FIG. 4B is a side view illustrating a front portion of a conventional front board module.
Figure 4A:
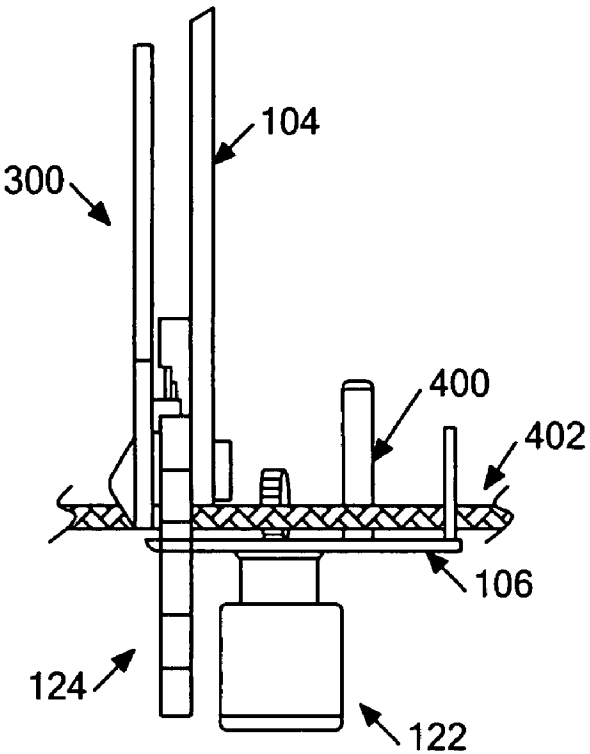
FIG. 4A (Prior Art)
FIG. 4A is a top view illustrating a front portion of a conventional front board module.
Figure 5:
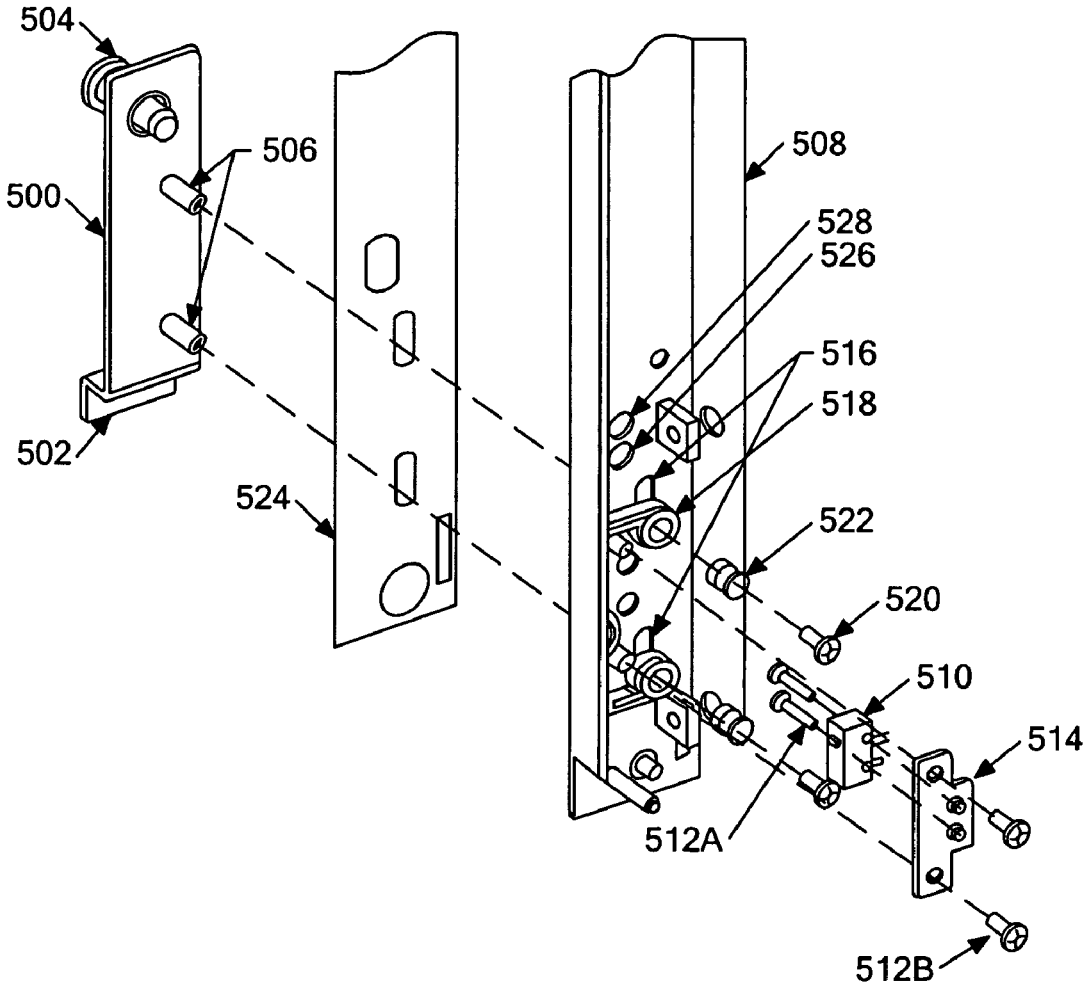
FIG. 5 illustrates a system for preventing disconnection of a module from a module connector prior to initiating a shutdown routine according to an aspect of the subject matter described herein.

According to one aspect illustrated by the exploded view of FIG. 5, a system for preventing disconnection of a module from a module connector prior to initiating a shutdown routine includes a covering member 500 having an elevated flange portion 502, a plunger 504 and standoffs 506. The term "module" as used herein denotes any hardware made to plug into and interact with a larger system or network. Examples of modules include the FBs or shelf managers in the ATCA system.

The rear side of a face plate 508 is also shown. Face plate 508 may be part of a module, such as a printed circuit board. In FIG. 5, the printed circuit board has been omitted for clarity. A switch 510 is mounted behind face plate 508 using various mounting hardware known in the art, such as screws 512A, 512B and support plate 514. Switch 510 has a first state during normal operation of the module and a second state for initiating shutdown of the module, as described further below.

Standoffs 506 of covering member 500 pass through corresponding oblong slots 516 in face plate 508 and secure to an actuator 518 with screws 520 and washers 522. Standoffs 506 are sized to move within corresponding oval slots 516 in face plate 508 to allow covering member 500 to slide up and down. An overlay 524 can be placed between covering member 500 and face plate 508 to add labeling and/or reconfigure some or all of the openings on face plate 508.

Covering member 500 is movable between first and second positions. Plunger 504 may be spring loaded to secure covering member 500 in each of the two positions. For example, in the first position spring-loaded plunger 504 is seated in corresponding hole 526 in face plate 508, and, in the second position, spring-loaded plunger 504 is seated in corresponding hole 528 in face plate 508. The operator pulls spring-loaded plunger 508 to disengage the plunger and allow movement between the first and second positions.

Figure 6B:
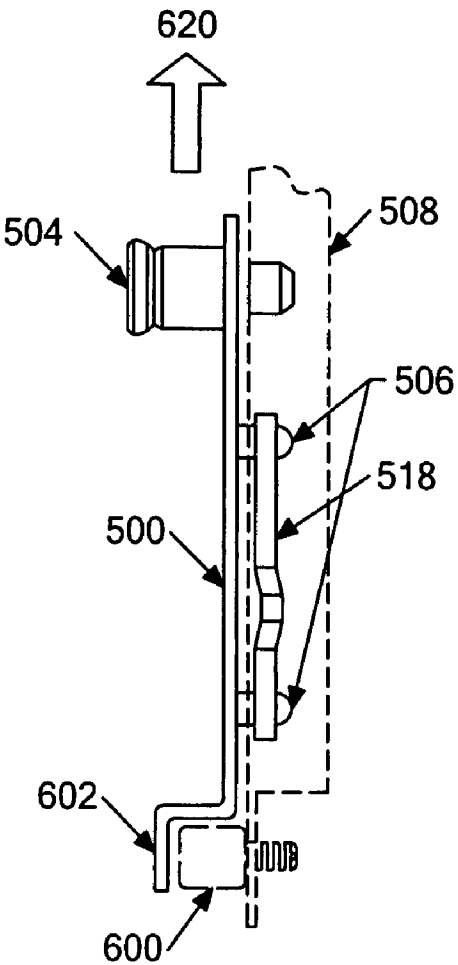
FIG. 6B is a side view illustrating a module face plate with a covering member in the first position according to an aspect of the subject matter described herein.
Figure 6A:
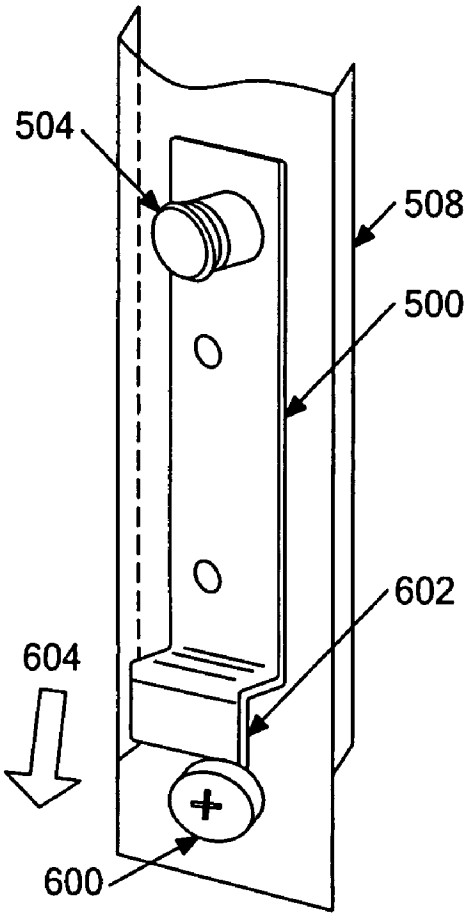
FIG. 6A is an isometric view illustrating a module face plate with a covering member according to an aspect of the subject matter described herein.

FIG. 6A is an isometric view illustrating a module face plate 508 with a covering member 500. A retention device 600 prevents disconnection of the module from the module connector, e.g., disconnection of the module connectors from connectors on a midplane. Retention device 600 can be a bolt or a screw, such as a thumb screw, or any other removable fastening/securing device known in the art. For example, the handles on the FB face plate described above can be employed as a retention device 600 instead of, or in addition to a screw or bolt. Covering member 500 is adapted to slide to selectively prevent access to retention device 600. That is, covering member 500 is movable between first and second positions with regard to retention device 600 and switch 510 (shown in FIG. 5), mounted on the rear of face plate 508. As shown in FIG. 6A, covering member 500 is in the second position (up) to allow access to retention device 600. In the up position, elevated flange portion 602 of covering member 500 does not block access to retention device 600. Covering member 500 can be slid down to the first position as indicated by arrow 604.

FIG. 6B is a side view illustrating a module face plate 508 with a covering member 500 in the first position (down). In the down position, an elevated flange portion 602 blocks access to retention device 600 while covering member 500 is in the first position. As illustrated in FIG. 5, standoffs 506 attach to a back side of covering member 500 and pass through corresponding slots 516 of face plate 508 of the module. Actuator 518 is mechanically coupled to covering member 500 via standoffs 506. Fasteners 520 secure standoffs 506 to actuator 518 through corresponding slots 516 while providing the standoffs 506 a range of motion within slots 516 for sliding covering member 500. As a result, actuator 518 moves with cover plate 500.

Figure 6C:
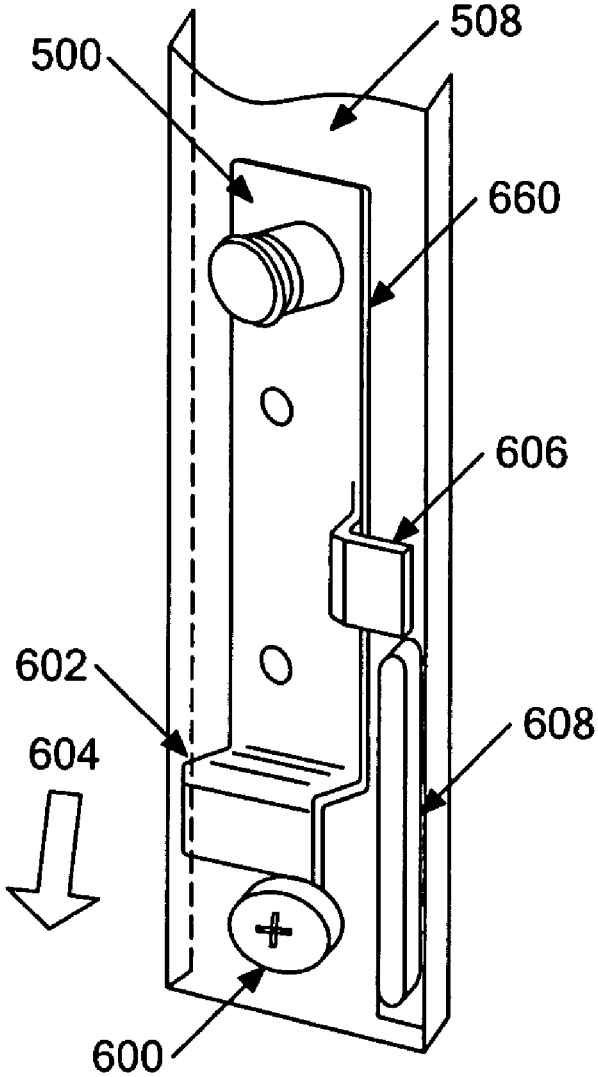
FIG. 6C illustrates a covering member that includes an elevated side flange for preventing access to a retention device according to an aspect of the subject matter described herein.

According to an alternate or additional feature of the methods and systems described herein, as shown in FIG. 6C, covering member 500 includes an elevated side flange 606 for preventing access to another retention device, such as a handle 608. In FIG. 6C a front view illustrating module face plate 508 with covering member 500 is shown. Elevated side flange 606 covers handle 608 when covering member 500 is in the first position. Handle 608 is rotated outward to eject the module. Accordingly, when covering member 500 is in the first position, elevated side flange 606 covers handle 608, thus preventing handle 608 from rotating outward to eject the module. Elevated side flange 606 can be employed instead of, or in addition to, elevated lower flange 602.

Figure 7:
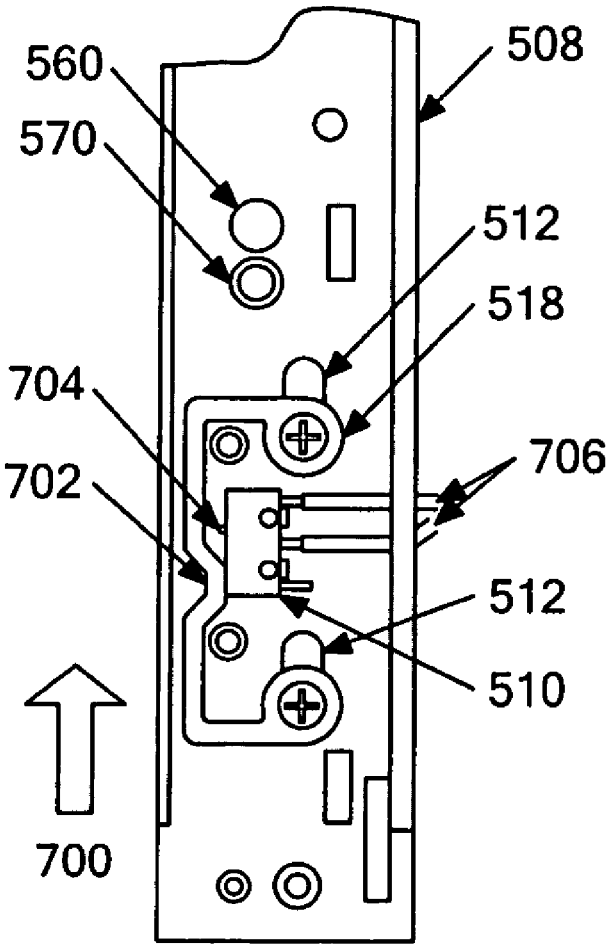
FIG. 7 illustrates the operation of the actuator and switch according to an aspect of the subject matter described herein.

FIG. 7 illustrates the operation of actuator 518 and switch 510. When covering member 500 is moved in a direction 700 from the first position to the second position, actuator 518, which is mechanically coupled to covering member 500 via standoffs 506 (shown in FIG. 5) moves with covering member 500. Actuator 518 includes an angled portion 702 that contacts a push-button 704 of switch 510. This action either opens or closes one or more sets of contacts within switch 510 to transition switch 510 from a first state to a second state. The transition of the switch 510 generates a state transition signal that is carried to a processor and/or other components via conductors 706 to initiate a shutdown routine. For example, switch 510 may send the state transition signal to a processor to interrupt the processor and initiate shutdown. In addition, the state transition signal or the interrupt service routine executed by the processor may trigger a standby module to go into active mode. For example, a standby module that is a "hot backup" of the module may be instructed to take over responsibility of the functions performed by the module that is about to be disconnected.

Accordingly, in the first position, the covering member prevents access to the retention device and the switch is in the first state, and in the second position, the covering member allows access to the retention device and changes the switch to the second state.

Figure 8:
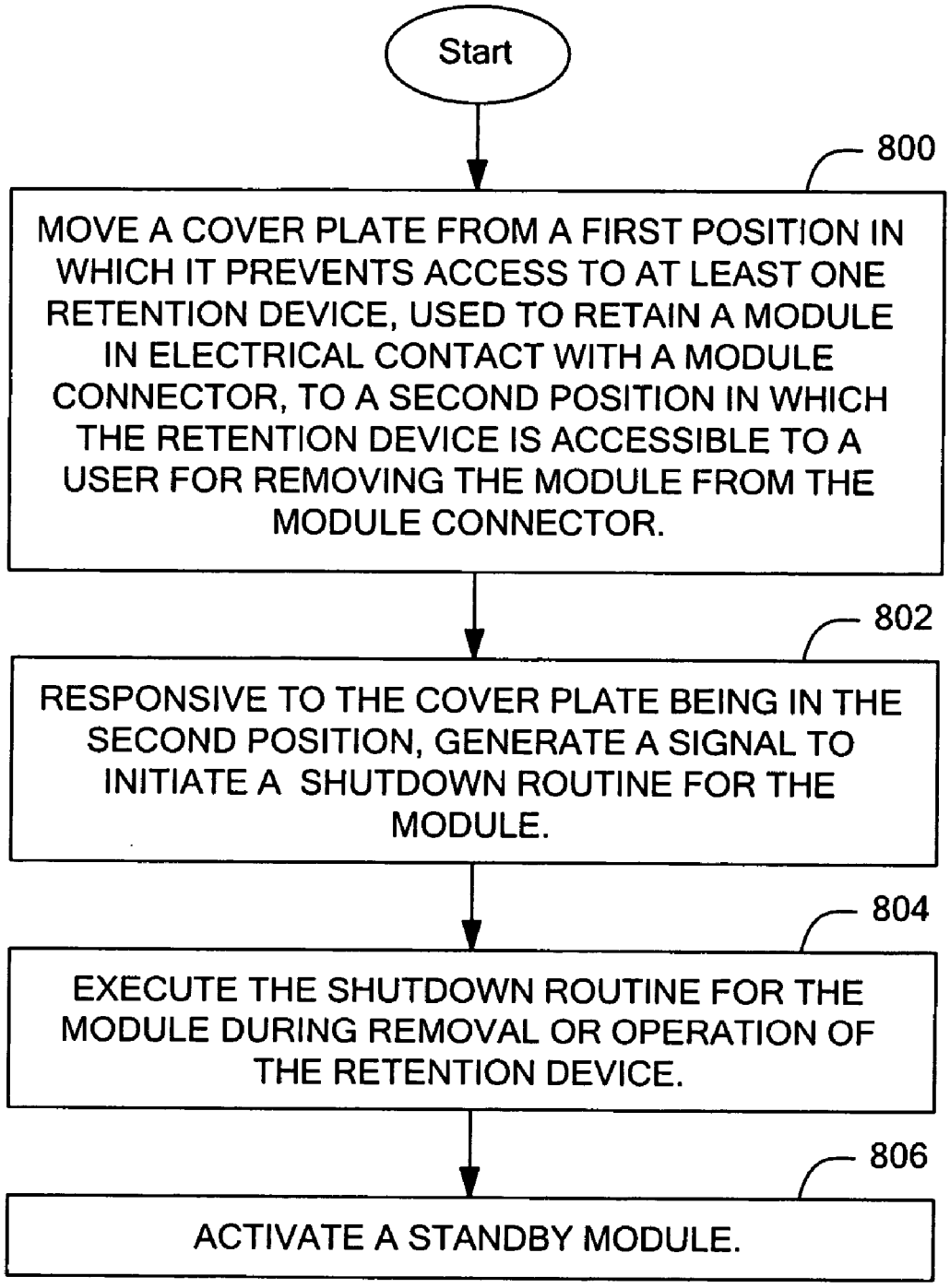
FIG. 8 is a flow chart illustrating a method for preventing disconnection of a module from a module connector prior to initiating a shutdown routine according to an aspect of the subject matter described herein.

FIG. 8 is a flow chart illustrating a method for preventing disconnection of a module from a module connector prior to initiating a shutdown routine. In step 800 covering member 500 is moved from a first position in which it prevents access to at least one retention device 600, used to retain a module in electrical contact with a module connector to a second position in which retention device 600 is accessible to a user for removing the module from the module connector. In step 802, responsive to covering member 500 being in the second position, a signal is generated to initiate a shutdown routine for the module. In step 804 the shutdown routine is executed during removal or operation of the retention device. In step 806, the signal that initiates the shutdown routine and/or the shutdown routine itself may activate a standby module.

As described above, executing the shutdown routine may include transitioning the processor to a known stable state so that it can be restarted without error. Because the shutdown routine is initiated simultaneously with granting access to the retention device, the likelihood that the shutdown routine will complete prior to module disconnection is increased over prior implementations. Once the shutdown routine is initiated, the retention device may be disengaged, e.g., unscrewed. Once the retention device is disengaged, the module can be disconnected from the module connector.

Figure 9:
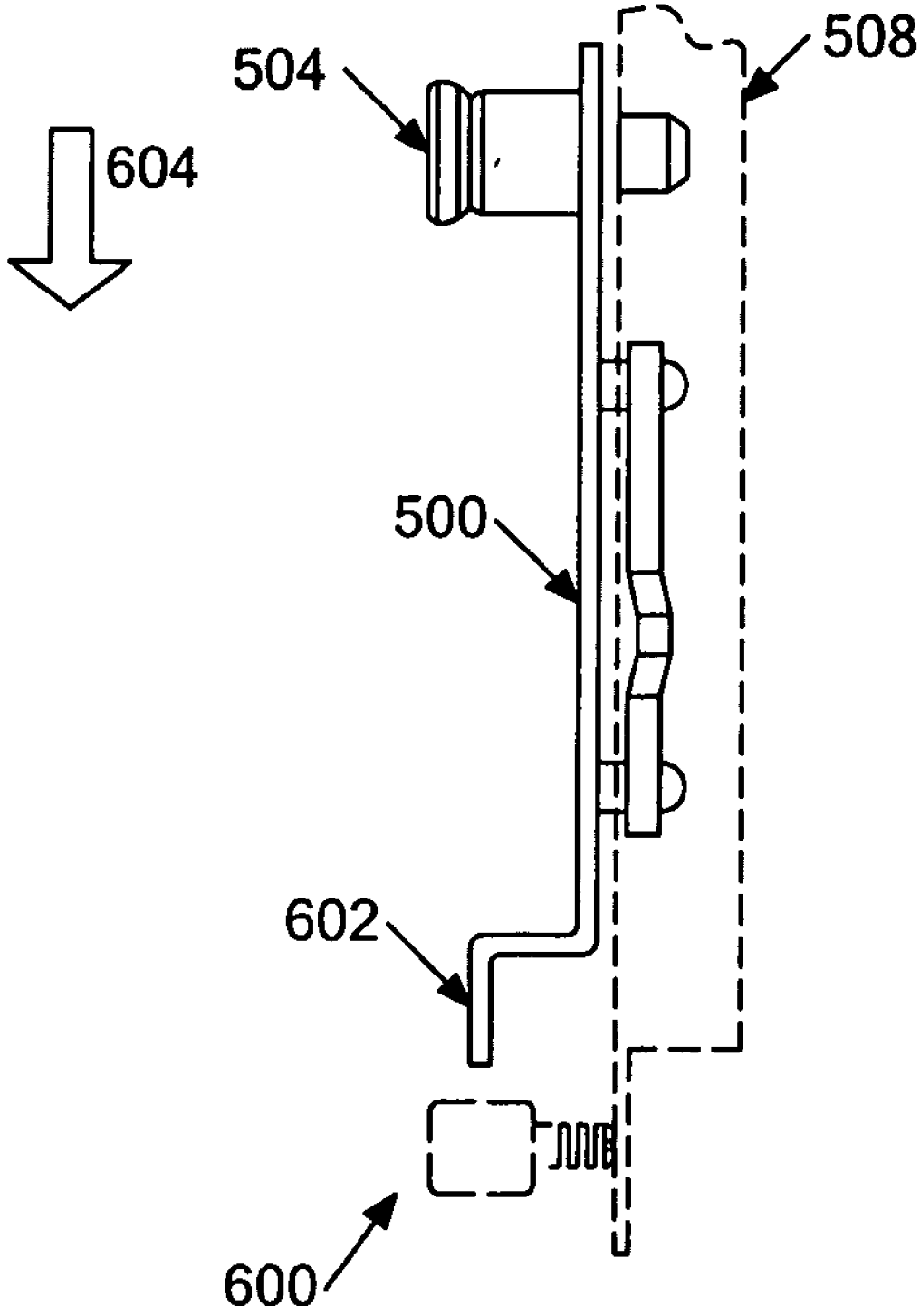
FIG. 9 illustrates a side view of a module face plate with a covering member in the second position according to an aspect of the subject matter described herein.

According to another aspect, systems and methods are disclosed for preventing operation of a module unless a retention device is engaged. FIG. 9 illustrates a side view of a module face plate 508 with a covering member 500 in the second position. Retention device 600 is not engaged. That is, retention device 600 is not screwed through module face plate 508 to secure FB 100 in place. As can be appreciated from FIG. 9, covering member 500 is prevented from moving, i.e., sliding down along direction 604, to the first position by the protruding retention device 600. Accordingly, covering member 500 can only be moved to the first position when retention device 600 is engaged. Consequently, since FB 100 is not operating, i.e., is shutdown or stopped, while covering member 500 is in the second position, operation of FB 100 is prevented while retention device 600 is not engaged.

This feature offers additional advantages. For example, an operator is prevented from operating FB 100 while retention device 600 is not engaged since FB 100 is stopped. This prevents the unintended disconnection, e.g., due to vibrations, of FB 100 from the midplane connectors. In addition, this ensures that retention device 600 is properly engaged so the module shutdown procedures described above can be implemented.

Figure 10:
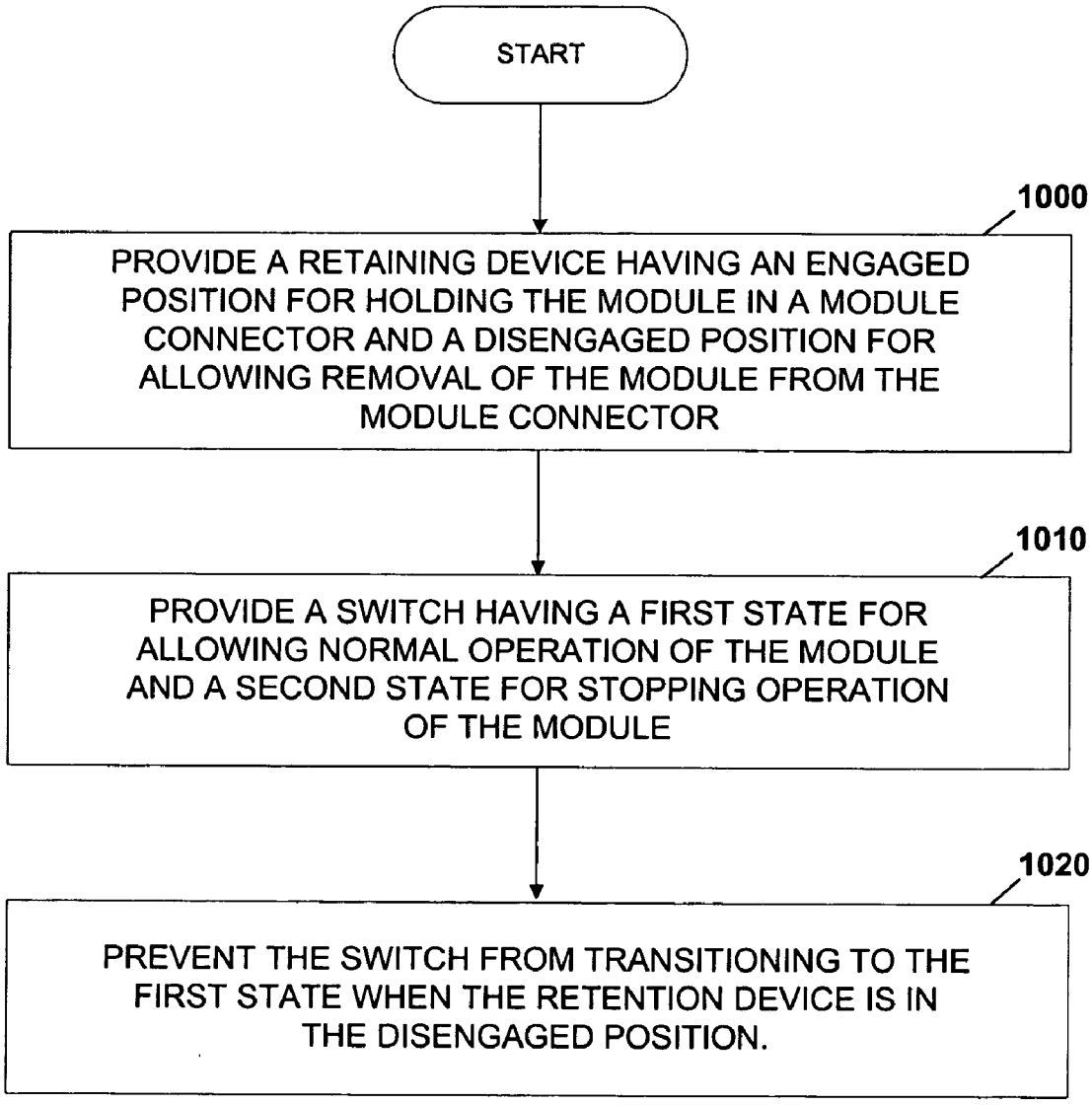
FIG. 10 is a flow chart illustrating a method for preventing operation of a module unless a retention device is engaged according to an aspect of the subject matter described herein.

FIG. 10 is a flow chart illustrating a method for preventing operation of a module unless a retention device is engaged. In step 1000, a retaining device having an engaged position for holding the module in a module connector and a disengaged position for allowing removal of the module from the module connector is provided. In step 1010, a switch having a first state for allowing normal operation of the module and a second state for stopping operation of the module is provided. In step 1020, the switch is prevented from transitioning to the first state when the retention device is in the disengaged position.

It will be appreciated by those of ordinary skill in the art that the subject matter disclosed can be embodied in various specific forms without departing from its essential characteristics. The disclosed embodiments are considered in all respects to be illustrative and not restrictive. For example, although only one covering member, retention device, etc., is shown and described, it will be understood that a plurality of covering members and/or retention devices can be used with a single module and that the covering member(s) can cover all or any subset of all the retention devices.

Moreover, although the exemplary embodiments disclosed show a sliding covering member, it should be understood that the covering member can be movable in any of a number of directions along any combination of three dimensions, so long as the first position prevents access to the retention device and the second position allows access to the retention device but initiates a shutdown routine. For example, the covering member could swing away from the face plate forward or to the side on a hinge or pivot connection.

Accordingly, it will be understood that various details of the invention may be changed without departing from the scope of the invention. Furthermore, the foregoing description is for the purpose of illustration only, and not for the purpose of limitation, as the invention is defined by the claims as set forth hereinafter.

What is claimed is:

1. A system for preventing disconnection of a module from a module connector prior to initiating a shutdown routine, the system comprising:

on a module comprising a hardware component adapted for insertion in a slot in a shelf of a rack-based computing system:

(a) a switch having a first state for allowing operation of the module and a second state for initiating a shutdown routine for controlling shutdown of the module;

(b) at least one retention device for preventing disconnection of the module from a module connector for electrically connecting the module to the rack-based computing system; and (c) a covering member being movable between first and second positions with regard to the retention device and the switch;

wherein, in the first position, the covering member prevents access to the retention device and the switch is in the first state, and in the second position, the covering member allows access to the retention device and wherein movement of the covering member from the first position to the second position transitions the switch to the second state.

2. The system of claim 1 wherein the switch is adapted to send an interrupt signal to a processor to initiate a shutdown routine for the module in response to the switch being in the second state.

3. The system of claim 2 wherein at least one of the switch and the shutdown routine is adapted to initiate activation of a standby module responsive to the switch being in the second state.

4. The system of claim 1 wherein the at least one retention device comprises a thumb screw.

5. The system of claim 1 wherein the at least one retention device comprises a handle for ejecting the module.

6. The system of claim 1 wherein the covering member is adapted to slide to selectively prevent access to the at least one retention device.

7. The system of claim 6 wherein the covering member comprises:

(a) at least one standoff attached to a back side of the covering member corresponding to and adapted to pass through a slot of a face plate of the module; and (b) a fastener for securing the at least one standoff through the slot while providing the at least one standoff a range of motion within the slot for sliding the covering member.

8. The system of claim 7 wherein the covering member comprises a plunger for locking the covering member in at least one of the first and second positions.

9. The system of claim 1 wherein the covering member comprises a plunger for locking the covering member in at least one of the first and second positions.

10. The system of claim 1 comprising an actuator mechanically coupled to the covering member and adapted to place the switch into the second state in response to the covering member being in the second position.

11. The system of claim 7 comprising an actuator mechanically coupled to the covering member and adapted to place the switch into the second state when the covering member is in the second position.

12. The system of claim 1 wherein the covering member comprises at least one elevated portion, the at least one elevated portion blocking access to the at least one retention device.

13. A system for preventing operation of a module unless a retention device is engaged, the system comprising:

on a module comprising a hardware component adapted for insertion in a slot in a shelf of a rack-based computing system:

(a) a switch having a first state for allowing operation of the module and a second state for preventing operation of the module;

(b) at least one retention device having an engaged position for preventing disconnection of the module from a module connector for electrically connecting the module to the rack-based computing system and a disengaged position for allowing disconnection of the module from the module connector; and (c) a covering member being movable between first and second positions with regard to the retention device and the switch, the covering member being operatively associated with the switch so that the switch is in the first state when the covering member is in the first position and so that the switch transitions to the second state when the covering member is moved to the second position;

wherein the covering member is prevented from moving to the first position and transitioning the switch to the first state when the retention module is in the disengaged position.

14. The system of claim 13 wherein the at least one retention device comprises a thumb screw.

15. The system of claim 13 wherein the at least one retention device comprises a handle for ejecting the module.

16. The system of claim 13 wherein the covering member is adapted to slide from the second position to the first position when the at least one retention device is in the engaged position.

17. The system of claim 16 wherein the covering member comprises:

(a) at least one standoff attached to a back side of the covering member corresponding to and adapted to pass through a slot of a lace plate of the module; and (b) a fastener for securing the at least one standoff through the slot while providing the at least one standoff a range of motion within the slot for sliding the covering member.

18. The system of claim 13 wherein the covering member comprises a plunger for locking the covering member in at least one of the first and second positions.

19. The system of claim 13 comprising an actuator mechanically coupled to the covering member and adapted to place the switch into the second state in response to the covering member being in the second position.

20. The system of claim 13 wherein the covering member comprises at least one elevated portion, the at least one elevated portion blocking access to the at least one retention device when the covering member is in the first position.

21. A method for preventing disconnection of a module from a module connector prior to initiating a shutdown routine, the method comprising:

on a module comprising a hardware component adapted for insertion in a slot in a shelf of a rack-based computing system:

(a) moving a covering member from a first position in which the covering member prevents access to at least one retention device used to retain the module in electrical contact with a module connector to a second position in which the retention device is accessible to a user for removing the module from the module connector; and (b) responsive to the covering member being in the second position, generating a signal to initiate a shutdown routine for the module.

22. The method of claim 21 wherein moving the covering member plate from the first position to the second position includes sliding the cover member from the first position to the second position.

23. The method of claim 21 wherein generating a shutdown signal includes actuating a switch operatively associated with the covering member, wherein the switch generates the shutdown signal.

24. The method of claim 23 wherein actuating the switch includes contacting the switch with an actuator being movable within the covering member.

25. The method of claim 21 comprising, responsive to the covering member being in the second position, initiating activation of a standby module.

26. The method of claim 21 comprising:

operating the retention device; and executing the shutdown routine during operation of the retention device.

27. The method of claim 26 wherein the retention device comprises a thumb screw and wherein operating the retention device includes unscrewing the thumb screw.

28. The method of claim 26 wherein the retention device comprises a handle and operating the retention device includes rotating the handle.

29. A method for preventing disconnection of a module from a module connector prior to initiating a shutdown routine, the method comprising:

on a module comprising a hardware component adapted for insertion in a slot in a shelf of a rack-based computing system:

(a) providing a switch having a first state for allowing normal operation of the module and a second state for initiating a shutdown routine for controlling shutdown of the module;

(b) providing at least one retention device for preventing disconnection of the module from a module connector for electrically connecting the module to the rack-based computing system;

(c) providing a covering member being movable between first and second positions with regard to the retention device and the switch; wherein, in the first position, the covering member prevents access to the retention device and the switch is in the first state, and in the second position, the covering member allows access to the retention device and movement of the covering member from the first position to the second position transitions the switch to the second state.

30. The method of claim 29 wherein providing a switch includes providing a switch that is adapted to send an interrupt signal to a processor to initiate a shutdown routine for the module in response to the switch being in the second state.

31. The method of claim 29 wherein providing a switch includes providing a switch that initiates a standby module when the switch is in the second state.

32. The method of claim 29 wherein providing at least one retention device includes providing a thumb screw.

33. The method of claim 29 wherein providing at least one retention device includes providing a handle for ejecting the module.

34. The method of claim 29 wherein providing a covering member includes providing a covering member that is adapted to slide to selectively prevent access to the at least one retention device.

35. The method of claim 34 wherein providing covering member includes providing a covering member comprising:

(a) at least one standoff attached to a back side of the covering member corresponding to and adapted to pass through a slot of a face plate of the module; and (b) a fastener for securing the at least one standoff through the slot while providing the at least one standoff a range of motion within the slot for sliding the covering member.

36. The method of claim 35 wherein providing a covering member includes providing a covering member comprising a plunger for locking the covering member in at least one of the first and second positions.

37. The method of claim 29 wherein providing a covering member includes providing a covering member comprising a plunger for locking the covering member in at least one of the first and second positions.

38. The method of claim 29 comprising providing an actuator mechanically coupled to the covering member and adapted to place the switch into the second state in response to the covering member being in the second position.

39. The method of claim 35 comprising providing an actuator mechanically coupled to the covering member and adapted to place the switch into the second state when the covering member is in the second position.

40. The method of claim 29 wherein providing a covering member includes providing a covering member having at least one elevated portion, the at least one elevated portion blocking access to the at least one retention device.

41. A method for preventing operation of a module unless a retention device is engaged, the method comprising:

on a module comprising a hardware component adapted for insertion in a slot in a shelf of a rack-based computing system:

(a) providing a retaining device having an engaged position for holding the module in a module connector for electrically connecting the module to the rack-based computing system and a disengaged position for allowing removal of the module from the module connector;

(b) providing a switch having a first state for allowing normal operation of the module and a second state for stopping operation of the module; and (c) preventing the switch from transitioning to the first state when the retaining device is in the disengaged position.

42. The method of claim 41 wherein providing a retention device comprises providing a thumb screw.

43. The method of claim 41 wherein providing a retention device comprises providing a handle.

44. The method of claim 41 wherein preventing the switch from transitioning to the first state comprises preventing the movement of a covering member from a second position to a first position when the retention device is in that disengaged position, the covering member being operatively associated with the switch so that the switch is in the first state when the covering member is in the first position and in the second state when the covering member is in the second position.

* * * * *